United States Patent [19]

Zoleski et al.

[11] 4,358,385

[45] Nov. 9, 1982

[54] LUBRICATING OIL COMPOSITION

[75] Inventors: Benjamin H. Zoleski, Beacon; Rodney L. Sung, Fishkill; Stephen A. Levine, Fishkill; William P. Cullen, Fishkill, all of N.Y.

[73] Assignee: Texaco Inc., White Plains, N.Y.

[21] Appl. No.: 291,581

[22] Filed: Aug. 10, 1981

[51] Int. Cl.[3] ..... C10M 1/48

[52] U.S. Cl. ..... 252/32.7 E; 252/33.4; 252/50; 252/51.5 A

[58] Field of Search ..... 252/32.7 E, 33.4, 50, 252/51.5 A

[56] References Cited

U.S. PATENT DOCUMENTS

| | | | |
|---|---|---|---|
| 2,320,392 | 6/1943 | White | 252/51.5 A X |
| 2,468,012 | 4/1949 | Isbell | 562/553 |
| 2,810,752 | 10/1957 | Freese | 562/553 |
| 3,003,961 | 10/1961 | Andress, Jr. et al. | 252/51.5 A X |
| 3,116,252 | 12/1963 | Beretvas | 252/51.5 A |
| 3,123,570 | 3/1964 | Bonner et al. | 252/32.7 E |
| 3,390,081 | 6/1968 | Floeck | 252/32.7 E |
| 3,856,687 | 12/1974 | Lowe | 252/33.4 |
| 4,086,172 | 4/1978 | Lowe | 252/32.7 E X |
| 4,210,541 | 7/1980 | Mann | 252/32.7 E |
| 4,283,294 | 8/1981 | Clarke | 252/42.7 X |

*Primary Examiner*—Andrew Metz

*Attorney, Agent, or Firm*—Carl G. Ries; Robert A. Kulason; James J. O'Loughlin

[57] ABSTRACT

A lubricating oil composition characterized by having a Total Base Number from about 5 to 40 comprising a mineral lubricating oil, an overbased calcium sulfonate, a zinc dihydrocarbyl dithiophosphate, an ethoxylated alkylphenol, an alkenylsuccinimide, a polymethacrylate, an ethylene-propylene copolymer, an alkylated diphenylamine and an N-alkylglycine derivative having the formula:

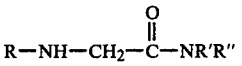

(a)

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or hydroxyalkyl radical having from 1 to 5 carbon atoms or a $-(CH_2-CH_2-NH)_xH$ radical in which x has a value from 1 to 3, or

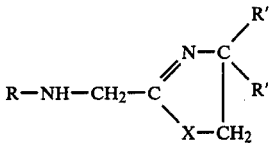

(b)

in which X represents an oxygen atom or a divalent N—R′ radical and R and R′ have the values noted above.

10 Claims, No Drawings

LUBRICATING OIL COMPOSITION

BACKGROUND OF THE INVENTION

Field of the Invention

Energy costs, particularly as illustrated by the cost of crude oil and liquid petroleum distillates derived from crude oil have escalated rapidly. These costs are especially burdensome to the users of transportation fuels who are major consumers of petroleum products and they are reacting by searching for more efficient measures to use in their operations. One significant development in the transportation field including over-the-road and marine propulsion units is the trend toward engines which are relatively more fuel efficient with respect to petroleum fuel compositions.

Crankcase lubricating oil compositions for gasoline engines and for medium and high speed diesel engines must possess a number of essential characteristics in order to be operable and to maintain their effectiveness for a satisfactory period of time. In general, such a lubricating oil composition must possess alkalinity expressed as Total Base Number ranging from about 5 to 40 TBN, anti-wear properties, dispersancy, good viscosity index properties, VI improver, oxidation inhibition and demulsifying properties.

The need to improve efficiency in the use of oil has spurred intensive efforts to discover a crankcase lubricating oil composition which can materially reduce the friction losses which take place within the engine itself. A reduction in engine friction losses translates directly into significant fuel savings. Numerous means have been employed to reduce the friction inside an internal combustion engine. These range from the use of a lower viscosity crankcase lubricating oil or a mixture of mineral and synthetic lubricating oils as well as to the incorporation of friction-reducing additives, such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic anti-friction additives which exhibit stability over an extended service life and under a wide range of operating conditions.

It is an object of this invention to provide a novel crankcase lubricating oil composition for medium and high speed engines.

It is another object of this invention to provide a crankcase lubricating oil composition having improved friction properties for lubricating medium and high speed engines.

DESCRIPTION OF THE PRIOR ART

U.S. Pat. No. 2,468,012 and 2,810,752 disclose methods for making amide derivatives of N-alkylglycine and their use as laundry detergents.

A copending application, Ser. No. 291,582, filed on Aug. 10, 1981, discloses a cylinder lubricating oil composition for a slow speed marine diesel engine.

A copending application, Ser. No. 291,584, filed on Aug. 10, 1981, discloses a marine crankcase lubricant for a large slow speed marine diesel engine.

SUMMARY OF THE INVENTION

The crankcase lubricating oil composition of this invention comprises a lubricating oil, an overbased calcium sulfonate in an amount sufficient to impart a Total Base Number ranging from about 5 to 40 to the lubricating oil composition, a zinc dihydrocarbyl dithiophosphate, an ethoxylated alkylphenol, an alkenylsuccinimide, a polymethacrylate, an ethylene-propylene copolymer, an alkylated diphenylamine and a minor amount of an N-alkylglycine derivative represented by the formula:

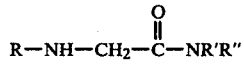

(I)

where R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3, or a derivative represented by the formula:

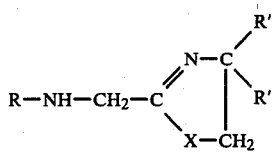

(II)

in which X represents an oxygen atom or a divalent N—R′ radical and R and R′ have values noted above.

The novel method of the invention involves operating a slow speed marine diesel engine by supplying the above-described lubricating oil composition to the crankcase lubrication system of said engine.

SPECIFIC EMBODIMENTS OF THE INVENTION

In a more specific embodiment of the invention, the crankcase lubricating composition of the invention will comprise at least 80 weight percent of a mineral lubricating oil, from about 0.1 to 5 weight percent of an overbased calcium sulfonate sufficient to impart a Total Base Number to the lubricating oil composition ranging between about 5 and 40, from about 0.1 to 2.5 weight percent of a zinc dihydrocarbyl dithiophosphate represented by the formula:

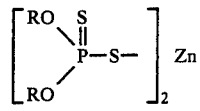

in which R is a hydrocarbyl radical or a hydroxy substituted hydrocarbyl having from about 4 to 12 carbon atoms, from about 0.05 to 1 weight percent of an ethoxylated alkylphenol having the formula:

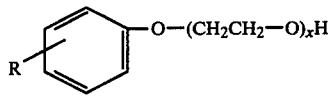

in which R is a hydrocarbyl radical having from about 4 to 16 carbon atoms and x has a value from 1 to 10, from about 0.5 to 10 weight percent of a nitrogen-containing succinimide dispersant represented by the formula:

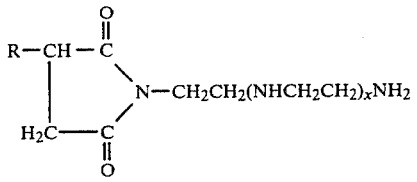

wherein R is alkenyl of from 50 to 200 carbons and x is an integer of from 0 to 10, from about 0.05 to 5 weight percent of a polymethacrylate VI improver represented by the general formula:

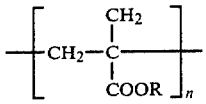

where R is an aliphatic radical of from 1 to 20 carbons and n is an integer of between about 600 and 35,000, from about 0.5 to 10 weight percent of an ethylene-propylene copolymer having a molecular weight ranging from about 20,000 to 50,000, from about 0.01 to 2.0 weight percent of an alkylated diphenylamine represented by the formula:

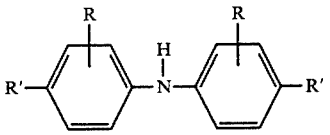

in which R is an alkyl radical having from 1 to 4 carbon atoms and R' is an alkyl radical having from about 4 to 16 carbon atoms, and a minor friction modifying amount of an N-alkylglycine derivative selected from the group having the formula:

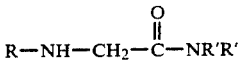

in which R is a hydrocarbyl radical having from about 10 to 25 carbon atoms, R' represents hydrogen or an alkyl, hydroxyalkyl or an aminoalkyl radical having from 1 to 5 carbon atoms, R'' represents an alkyl or a hydroxyalkyl radical having from 1 to 5 carbon atoms or a $-CH_2-(CH_2-NH)_xH$ radical in which x has a value from 1 to 3, and a derivative represented by the formula:

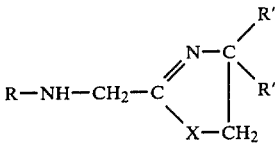

in which X represents an oxygen atom or a divalent N—R' radical and R and R' have the values noted above.

A preferred N-alkylglycine-amide friction modifying component of the lubricating oil composition of the invention is represented by the following formula:

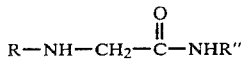

in which R is an alkyl radical having from about 12 to 20 carbon atoms and R'' is a $-(CH_2-CH_2-NH)_xH$ radical in which x has a value from 1 to 2. A still more preferred compound of this type is one in which R has from 16 to 18 carbon atoms.

The essential N-alkylglycine amide friction modifier of the invention is generally prepared in two steps involving first the reaction of an aliphatic primary amine with a halogenated acetic acid, such as chloroacetic acid, to form the intermediate N-alkylglycine followed by a reaction of the intermediate N-alkylglycine with an amine to form the prescribed N-alkylglycine-amide.

The aliphatic primary amines which can be employed in the first step of this process are represented by the formula $RNH_2$ in which R is a monovalent saturated or unsaturated aliphatic hydrocarbon or hydrocarbyl radical having from about 10 to 25 carbon atoms. The preferred aliphatic primary amines have from 12 to 20 carbon atoms with the most preferred having from 16 to 18 carbon atoms. The aliphatic primary amines found to be effective are those having essentially straight chain alkyl radicals. Aliphatic monoamines having a minor amount of chain branching, i.e. less than about 5 percent branched alkyl radicals attached to the main straight chain or backbone hydrocarbyl radical can be employed.

Examples of specific aliphatic primary amines suitable for this reaction include n-decylamine, n-dodecylamine, n-tetradecylamine, n-hexadecylamine, n-octadecylamine and aliphatic primary amines derived from natural products, such as coco-amine which averages about 12 aliphatic carbon atoms, and tallow-amine, oleylamine and soya-amine which average about 18 aliphatic carbon atoms.

The aliphatic primary amine is reacted with a halogenated acid represented by the formula:

$$XCH_2-COOH$$

in which X represents a halogen atom, such as chlorine, bromine and iodine to produce an intermediate N-alkylglycine as illustrated below:

$$R-NH_2+XCH_2-COOH \rightarrow R-NH-CH_2-COOH+HX$$

In general, the aliphatic primary amine is dissolved in an inert solvent, such as a hydrocarbon solvent, together with an acid acceptor. The haloacetic acid is gradually added to the mixture and the entire mixture is then heated to its reflux temperature and maintained at this temperature for a sufficient length of time for the reaction to be completed. This intermediate reaction mixture is then filtered and cooled.

In the second step, the mixture containing the intermediate N-alkylglycine is reacted with an amine compound which can react with the carboxylic acid group on the N-alkylglycine to form an amide. The amine compound which can be employed in this step of the process is represented by the formula:

HNR'R'' in which R' represents hydrogen or an alkyl, hydroxyalkyl or aminoalkyl radical having from 1 to 5 carbon atoms and R'' represents an alkyl or a hydroxyalkyl radical having from 1 to 5 carbon atoms or a $-(CH_2-CH_2-NH)_xH$ radical in which x has a value from 1 to 3. Examples of amines suitable for this step in the process include ethylenediamine, diethylenetriamine, triethylenetetramine, diethanolamine, N-ethylethylenediamine, and 1,3-propanediamine.

In the final step of the process, the prescribed amine compound is added to the solvent mixture containing the intermediate N-alkylglycine and this new mixture is heated to its reflux temperature and maintained at this temperature until all the water split out in the reaction has been removed. The final reaction product is filtered and stripped of solvent under a vacuum.

The following examples illustrate the preparation of specific friction reducing additive component for the diesel crankcase oil composition of the invention.

EXAMPLE I

Preparation of N,N-bis(2-hydroxyethyl)-N'-tallow glycine amide 276 parts of a commercial tallow-amine (Armeen T-tallow amine) and 53 parts of sodium carbonate were dissolved in a solvent mixture of 400 parts hexane and 400 parts xylene. 94 parts of chloroacetic acid were slowly added to this mixture. The mixture was then heated to reflux temperature and maintained at this temperature until all the water formed in the reaction was removed as an azeotrope. The intermediate reaction product containing N-tallow-glycine was then cooled.

104 parts of diethanolamine was added to the foregoing intermediate reaction product and the new mixture heated to reflux temperature and maintained at this temperature until all of the water of the reaction had been removed as an azeotrope. The final reaction product was filtered and stripped of solvent under a vacuum. The product was analyzed by elemental analysis and IR indicating the preparation of the prescribed product corresponding to the formula:

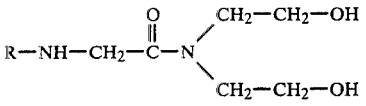

wherein R represents a hydrocarbyl radical derived from tallow.

EXAMPLE II

Preparation of tallow glycyl amide of ethylenediamine 275 parts of tallow-amine (Armeen T), and 53 parts of sodium carbonate were added to a mixture consisting of 400 parts of xylene and 400 parts of hexane. 95 parts of chloroacetic acid were slowly added to this mixture. The mixture was heated to reflux temperature and maintained at this temperature until all the water produced in the reaction had been removed completing the formation of the N-tallow-glycine.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-tallow-glycyl amide of ethylenediamine corresponding to the formula:

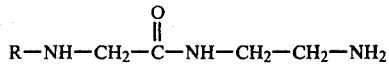

wherein R represents a hydrocarbyl radical derived from tallow.

EXAMPLE III

Preparation of N-oleyl glycyl amide of ethylenediamine 270 parts of oleyl-amine (Armeen O), and 53 parts of sodium carbonate were added to a mixture consisting of 400 parts of xylene and 400 parts of hexane. 945 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-oleyl-glycyl amide of ethylenediamine corresponding to the formula:

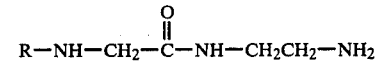

wherein R represents a hydrocarbylene radical derived from oleic acid.

EXAMPLE IV

Preparation of N-coco glycyl amide of ethylenediamine 204 parts of coco-amine (Armeen C derived from coconut oil) and 53 parts of sodium carbonate were added to a mixture consisting of 400 parts of xylene and 400 parts of hexane. 94.5 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until the water of reaction had been removed. The filtered and stripped final product was analyzed by elemental analysis and IR indicating the preparation of N-coco-glycyl amide of ethylenediamine corresponding to the formula:

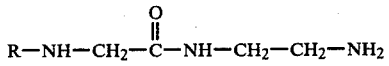

wherein R represents a hydrocarbyl radical derived from coco.

EXAMPLE V

Preparation of
1-(2-ethylamine)-2-N-tallow-aminomethyl)imidazoline 275 parts of a primary amine obtained by aminating tallow (Armeen T), 79 parts of pyridine were added to a mixture consisting of 400 parts xylene and 400 parts hexane. 25 parts of chloroacetic acid were added to the mixture. This mixture was refluxed for 3 hours and filtered and cooled.

77 parts of diethylenetriamine was added to onehalf of the foregoing product mixture and this reaction mixture was heated to reflux and maintained at this temperature until the whole other water separated in the reaction had been azeotroped from the reaction mixture. The final reaction product was filtered and stripped under a vacuum and analyzed by elemental analyses and IR and found to contain 1-(2-ethylamine)-2-(N-tallow-aminomethyl)imidazoline corresponding to the formula:

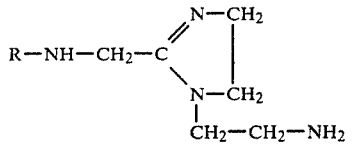

in which R is a hydrocarbyl radical derived from tallow.

EXAMPLE VI

Preparation of
2-(N-tallow-aminomethyl)-4-ethyl-4-methylol-oxazoline 47.5 parts of chloroacetic acid were slowly added to a mixture of 137.5 parts of tallow-amine (Armeen T) and 39.5 parts of pyridine in 200 parts hexane and 200 parts xylene. On completion of a chloroacetic acid condition, the reaction mixture was refluxed for 3 hours and then cooled. 59.5 parts of 2-amino-2-ethyl-1,3-propanediol were added to the foregoing intermediate reaction product and the new reaction mixture was heated to reflux and maintained at this temperature until all the water separated in the reaction had been removed. The final reaction product was filtered and stripped and analyzed by elemental analysis and IR to indicate the presence of 2-(N-tallow-aminomethyl)-4-ethyl-4-methylol-oxazoline having the formula:

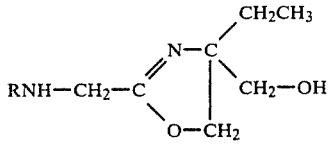

in which R is a hydrocarbyl radical derived from tallow.

The friction modifying component of the diesel cylinder lubricating oil composition of the invention is effective in a range from about 0.1 to 5 weight percent based on the total lubricating oil composition. However, it is preferred to employ from about 0.5 to 2 weight percent of the N-alkylglycine derivative on the lubricating oil with the most preferred concentration ranging from about 0.75 to 1.5 weight percent.

The second essential component of the cylinder lubricating oil composition of the invention is an overbased calcium sulfonate having a Total Base Number ranging from 300 to 450 on an active material or neat basis. This component is employed in the finished cylinder lubricating oil at a concentration ranging from about 0.1 to 5 weight percent based on the weight of the lubricating oil composition and sufficient to provide a lubricating oi having a Total Base Number from about 5 to 40. A preferred overbased calcium sulfonate has a TBN ranging from about 350 to 425, a preferred concentration of the sulfonate in the lubricating oil is from about 0.5 to 2.0 weight percent and a preferred TBN for the lubricating oil composition is from 10 to 30. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. No. 3,779,920 and U.S. Pat. No. 4,131,551 and the disclosures in these references are incorporated herein by reference. In a preferred concentration, the overbased calcium sulfonte will provide from about 0.15 to 0.25 weight percent of calcium to the finished lubricating oil composition of the invention.

The essential zinc dithiophosphate component of the lubricating oil is represented by the formula:

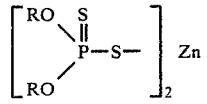

in which R is a hydrocarbyl radical or a hydroxy-substituted hydrocarbyl radical having from 4 to 12 carbon atoms. The preferred zinc dithiophosphates are those in which R represent an alkyl radical having from 4 to 8 carbon atoms. Examples of suitable compounds include zinc isobutyl 2-ethylhexyl dithiophosphate, zinc di(2-ethylhexyl) dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging from about 0.1 to 1.0 weight percent with a preferred concentration ranging from about 0.5 to 1.5 percent. In general, the zinc dithiophosphate component is employed in a concentration necessary to provide from about 0.05 to 0.20 weight percent phosphorus to the finished oil composition. These compounds can be prepared from the reaction of a suitable alcohol or mixture of alcohols with phosphorus pentasulfide. They are illustrated in U.S. Pat. No. 2,344,395, 3,293,181 and 3,732,167 which are incorporated herein by reference.

The ethoxylated alkylphenol is an essential demulsification and water separation component for a diesel crankcase lubricating oil composition. This component is represented by the formula:

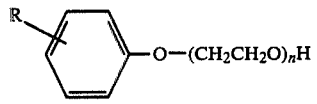

wherein R represents an alkyl radical having from 4 to 20 carbon atoms and n has an average value ranging from about 4 to about 30. A preferred ethoxylated alkylphenol is one in which R is an alkyl radical having from about 8 to 12 carbon atoms and n has a value ranging from 5 to 10. Ethoxylated alkylphenols are disclosed in U.S. Pat. No. 3,548,949 and this disclosure is incorporated herein by reference.

The ethoxylated alkylphenol is employed in the lubricating oil composition of the invention in a concentration ranging from about 0.025 to 1 weight percent. However, it is preferred to employ from about 0.1 to 0.25 weight percent of this additive with the most preferred concentration being from about 0.15 to 0.2 weight percent.

The essential oxidation inhibitor for the lubricating oil composition of the invention is an alkylated diphenylamine represented by the formula:

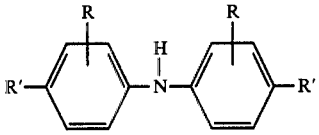

in which R is an alkyl radical having from 1 to 4 carbon atoms and R' is an alkyl radical having from about 4 to 16 carbon atoms. A more preferred compound is one in which R' is a tertiary alkyl hydrocarbon radical having from 6 to 12 carbon atoms. Examples of typical compounds include 2,2'-diethyl, 4,4'-tert. dioctyldiphenylamine, 2,2-diethyl, 4,4'-tert. dioctylphenylamine 2,2'-diethyl, 4-tert. octyldiphenylamine, 2,2'dimethyl-4,4'tert. dioctyldiphenylamine, 2,5-diethyl, 4,4'-tert.-dihexyldiphenylamine, 2,2,2',2'-tetraethyl, 4,4'-tert. didodecyldiphenylamine and 2,2'dipropyl 4,4'-tert. dibutyldiphenylamine. Mixtures of the foregoing compounds can be employed with equal effectiveness. The alkylated diphenylamine is normally employed in an oil composition in a concentration ranging from about 0.05 to 1 weight percent based on the weight of the lubricating oil composition, with the preferred concentration being from about 0.25 to 0.20 percent.

The essential nitrogen-containing succinimide dispersant is represented by the formula:

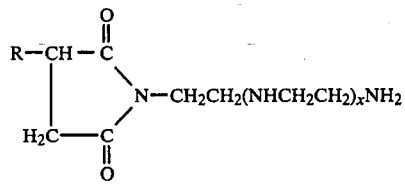

wherein R is alkenyl of from 50 to 200 carbons and x is an integer of from 0 to 10. Particularly suitable examples are where R is polyisobutylene of a molecular weight of about 1000 to 1500 and x is 3 or 4 and mixtures thereof.

The nitrogen-containing dispersants are disclosed in U.S. Pat. No. 3,131,150, 3,272,746 and U.S. Pat. No. 3,172,892. These citations are incorporated herein by reference.

The dispersant is normally employed in the lubricating oil composition of the invention in a concentration ranging from about 0.5 to 10 weight percent based on the weight of the lubricating oil composition. A preferred concentration for a succinimide dispersant is from about 2 to 5 weight percent.

The essential viscosity index improver is a polymethacrylate represented by the formula:

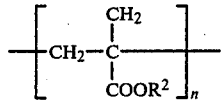

where $R^2$ is an aliphatic radical of from 1 to 20 carbons and n is an integer of between about 600 and 35,000. One of the most suitable VI improvers is the tetrapolymer of butyl methacrylate, dodecyl methacrylate, octadecyl methacrylate, and dimethylaminoethyl methacrylate having a respective component weight ratio in the polymer of about 4:10:5:1. The polymethacrylate VI improver is disclosed in U.S. Pat. No. 4,021,357 and this disclosure is incorporated herein by reference.

The polymethacrylate VI improver is normally employed in the lubricating oil composition of the invention in a concentration ranging from about 0.025 to 2.5 weight percent. It is preferred, however, to employ the VI improver in a concentration ranging from about 0.1 to 0.5 weight percent.

Another important VI improver is a copolymer of ethylene and propylene having a molecular weight of 20,000 to 50,000 containing 30 to 50 percent propylene in the copolymer in admixture with solvent neutral oil comprising 13 weight percent copolymer and 87 weight percent oil. Ethylene-propylene copolymers are disclosed in U.S. Pat. No. 3,522,180 and this disclosure is incorporated herein by reference. Ethylene-propylene copolymers are employed in the lubricating oil compositions of the invention in a concentration ranging from about 0.5 to 10 weight percent and preferably from about 1 to 5 percent.

Unless otherwise noted, the concentrations of the additive components of the lubricating oil composition of the invention are given on an active material or a neat basis based on the weight of the finished lubricating oil composition. It will be appreciated that in some instances convenience dictates the employment of oil solutions of the additives.

The hydrocarbon oil which can be employed to prepare the diesel lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between 100 and 1200, are normally employed for the lubricant composition. The most preferred lubricating viscosity for a crankcase lubricating oil composition is a viscosity ranging from about 56 to 68 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel crankcase lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel lubricating oil composition of the invention containing the prescribed N-alkylglycine friction modifier was evaluated in a commercial marine diesel lubricating oil composition. The commercial lubricant or base oil and the modified oil containing the friction modifier of the invention were tested for their friction properties in the Small Engine Friction Test described above.

The following examples illustrate the effectiveness of the additive of the invention in a 6 TBN marine crankcase oil composition.

TABLE I

SMALL ENGINE FRICTION TEST ON TBN CRANKCASE OIL

| Composition, Wt. % | Crankcase Oil (Base Oil) | Modified Crankcase Oil A | Modified Crankcase Oil B |
|---|---|---|---|
| Solvent Neutral Oil CST at 100° F. of 32.5 | 10.0 | 10.0 | 10.0 |
| Solvent Neutral Oil CST at 100° F. of 27 | 66.4 | 65.9 | 65.9 |
| Overbased Calcium Sulfonate[1] | 1.48 | 1.48 | 1.48 |

TABLE I-continued

SMALL ENGINE FRICTION TEST ON TBN CRANKCASE OIL

| Composition, Wt. % | Crankcase Oil (Base Oil) | Modified Crankcase Oil A | Modified Crankcase Oil B |
|---|---|---|---|
| Zinc Dithiophosphate[2] | 1.43 | 1.43 | 1.43 |
| Ethoxylated phenol[3] | 0.15 | 0.15 | 0.15 |
| Alkenylsuccinimide[5] | 8.69 | 8.69 | 8.69 |
| Polymethacrylate polymer | 0.10 | 0.10 | 0.10 |
| Alkylated diphenylamine[4] | 0.25 | 0.25 | 0.25 |
| Ethylene-propylene copolymer[6] | 11.5 | 11.5 | 11.5 |
| Dimethyl silicone, ppm | 150 | 150 | 150 |
| Additive of Example II | — | 0.5 | — |
| Additive of Example III | — | — | 0.5 |

[1]Overbased calcium sulfonate of TBN (Surchem 306)
[2]Zinc salt of mixed ($C_3$–$C_7$) alcohols/$P_2S_5$ product; 11.5% Zn
[3]Nonylphenol ethoxylated with 6 ethylene oxide moieties
[4]A mixture of mono- and dinonyldiphenylamine (Vanlube NA)
[5]A 50 wt. percent oil solution of alkenylsuccinimide of triethylenetetramine
[6]A 13 wt. percent oil solution of amorphous copolymer having a molecular weight from 20,000 to 50,000.

TABLE II

SMALL ENGINE FRICTION TEST

| | Crankcase Oil (Base Oil) | Modified Crankcase Oil (Oil A) | Modified Crankcase Oil (Oil B) |
|---|---|---|---|
| Engine Motor Torque, Foot Lbs. at 280° F. | 2.875 | 2.45 | 2.51 |
| Decrease in Torque ft.-lbs. | — | 0.425 | 0.365 |
| Decrease in Torque, % | — | 14.8 | 14.2 |

The foregoing examples demonstrate the effectiveness of the N-hydrocarbyl glycyl amide of alkylene polyamines as surprisingly effective as friction modifiers for reducing engine motor torque in the prescribed crankcase oil composition of the invention. Significant fuel economies are realized from the use of the prescribed lubricating oil composition of the invention.

We claim:

1. A crankcase lubricating oil composition having a Total Base Number ranging from about 5 to 40 comprising a major proportion of a mineral lubricating oil containing from about 0.1 to 5 weight percent of at least one overbased calcium sulfonate, from about 0.1 to 1 weight percent of a zinc dithiophosphate represented by the formula:

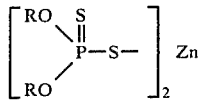

in which R is a hydrocarbyl radical or a hydroxy substituted hydrocarbyl radical having from 4 to 12 carbon atoms, from about 0.025 to 1 weight percent of an ethoxylated alkylphenol represented by the formula:

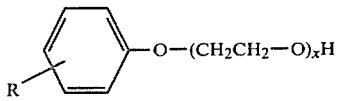

wherein R represents an alkyl radical having from 4 to 20 carbon atoms and n has an average value ranging from about 4 to about 30, from about 0.05 to 1 weight percent of an alkylated diphenylamine represented by the formula:

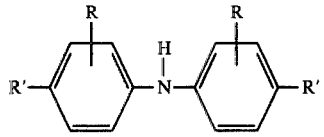

in which each R is an alkyl radical having from 1 to 4 carbon atoms and each R′ is an alkyl radical having from about 4 to 16 carbon atoms, from about 0.5 to 10 weight percent of nitrogen-containing dispersant represented by the formula:

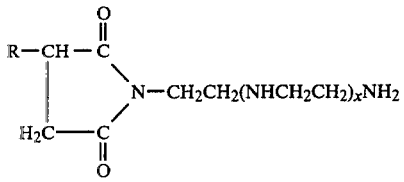

wherein R is alkenyl of from 50 to 200 carbons and x is an integer of 0 to 10, from about 0.25 to 2.5 weight percent of a polymethacrylate having the formula:

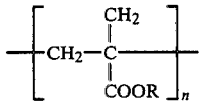

where R is an aliphatic radical of from 1 to 20 carbons and n is an integer of between about 600 and 35,000, from about 0.5 to 10 weight percent of an ethylene propylene copolymer having a molecular weight ranging from about 20,000 to 50,000, and, from about 0.1 to 5 weight percent of an N-alkylglycine derivative selected from the group consisting of:

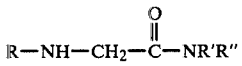

(a)

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or hydroxyalkyl radical having from 1 to 5 carbon atoms or a $-(CH_2-CH_2-NH)_xH$ radical in which x has a value from 1 to 3, and

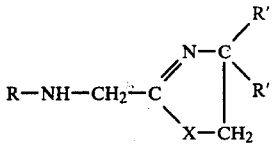

(b)

in which X represents an oxygen atom or a divalent N—R′ radical and R and R′ have the values noted above.

2. A lubricating oil composition according to claim 1 in which said N-alkylglycine derivative is represented by the formula:

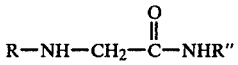

in which R is a hydrocarbyl radical having from 10 to 20 carbon atoms and R″ is a $-(CH_2-CH_2-NH)_xH$ radical in which x has a value from 1 to 2.

3. A lubricating oil composition according to claim 1 in which R in said N-alkylglycine derivative is a hydrocarbyl radical having from 16 to 18 carbon atoms.

4. A lubricating oil composition according to claim 1 in which overbased calcium sulfonate is derived from petroleum sulfonic acids or alkylated benzene sulfonic acids having from about 12 to 200 carbon atoms.

5. A lubricating oil composition according to claim 1 containing from about 0.5 to 2 weight percent based on said lubricating oil composition of said N-alkylglycine derivative.

6. A lubricating oil composition according to claim 1 in which said N-alkylglycine derivative is N-tallow glycyl amide of ethylenediamine represented by the formula:

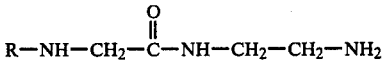

wherein R represents a hydrocarbyl radical derived from tallow.

7. A lubricating oil composition according to claim 1 in which said N-alkylglycine derivative is N-coco glycyl amide of ethylenediamine represented by the formula:

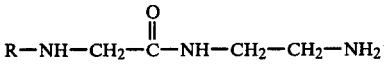

wherein R represents a hydrocarbyl radical derived from coconut oil.

8. A lubricating oil composition according to claim 1 in which said N-alkylglycine derivative is N,N-bis(2-hydroxyethyl)-N′-tallow glycine amide.

9. A lubricating oil composition according to claim 1 in which the concentration of said N-alkylglycine derivative ranges from about 0.75 to 1.5 weight percent.

10. A lubricating oil composition according to claim 1 characterized by having a TBN ranging from about 15 to 30.

* * * * *